343-754 SR
2/25/86 XR 4,573,056

United States Patent [19]

Dudôme et al.

[11] Patent Number: 4,573,056

[45] Date of Patent: Feb. 25, 1986

[54] DIPOLE RADIATOR EXCITED BY A SHIELDED SLOT LINE

[75] Inventors: Michel Dudôme; Albert Dupressoir, both of Paris, France

[73] Assignee: Thomson CSF, Paris, France

[21] Appl. No.: 448,473

[22] Filed: Dec. 10, 1982

[30] Foreign Application Priority Data

Dec. 18, 1981 [FR] France ..... 81 23735

[51] Int. Cl.[4] ..... H01Q 1/38; H01Q 9/16

[52] U.S. Cl. ..... 343/795; 343/754; 343/822; 343/851

[58] Field of Search ..... 343/727, 730, 793, 794, 343/795, 807; 343/851, 754, 822

[56] References Cited

U.S. PATENT DOCUMENTS

| | | | |
|---|---|---|---|
| 3,623,112 | 11/1971 | Rupp et al. | 343/727 |
| 4,001,834 | 1/1977 | Smith | 343/754 |
| 4,114,163 | 9/1978 | Borowick | 343/795 |
| 4,287,518 | 9/1981 | Frosch | 343/700 MS |
| 4,298,878 | 11/1981 | Dupressoir et al. | 343/795 |
| 4,445,122 | 4/1984 | Pues | 343/851 |

FOREIGN PATENT DOCUMENTS

| | | | |
|---|---|---|---|
| 2138384 | 2/1973 | Fed. Rep. of Germany . | |
| 2379196 | 4/1976 | France . | |
| 1348478 | 3/1974 | United Kingdom | 343/793 |

*Primary Examiner*—Eli Lieberman

*Attorney, Agent, or Firm*—Cushman, Darby & Cushman

[57] ABSTRACT

An electromagnetic wave radiator is provided formed by a radiating element and its supply device, both formed from a dielectric plate with median longitudinal axis, metalized on one face along two parallel strips of total width $d_2$, wherein the supply device is formed by a slot-line placed inside a metal parallelepipedic case. The radiating element may be of the dipole type. Such a wave radiator may be used as an elementary source for an electronic sweep network antenna.

24 Claims, 13 Drawing Figures

DIPOLE RADIATOR EXCITED BY A SHIELDED SLOT LINE

BACKGROUND OF THE INVENTION

The present invention relates generally to electromagnetic wave radiators, operating at ultra-high frequencies, and relates more particularly to a wave radiator formed from a plate of a metalized dielectric substrate.

A particularly interesting field of application of the invention is that of small-sized radar antennae operating in a wide frequency band, used either as primary sources illuminating focussing optical systems or as elementary sources for an electronic sweep network antenna for example.

The radio-electric characteristics required at the present time for electronic sweep antenna sweeping space by means of the beam(s) which they radiate are such that it is necessary to use elementary sources taking up little space both in the transverse direction to comply with the pitch between these sources on which the deflection qualities of the antenna depend and in the longitudinal direction so that they are not fragile.

In numerous cases, the solution chosen consists in using either half-wave dipoles printed on a dielectric plate or elements of the "patch" type excited by a microstrip line.

In the example given in the English patent published under the No. 1 348 478, the radiating dipole is fed by a printed slot line on the same face of the dielectric plate as the stems of the dipole, a transition being provided between the slot line and the dipole to ensure good matching.

Since these two types of source only operate correctly as a rule at resonance, they cannot present a large acceptable band-width (standing wave rate less than or equal to 1.5 and radiating diagram without excessive deformation).

For elements of the "patch" type, a band-width of 5% can scarcely by exceeded and for dipoles a double width is considered as good for elements printed on a substrate and excited by a conventional coaxial line.

The aim of the present invention is to remedy these disadvantages by proposing an electromagnetic wave radiator operating over a large frequency band width, having a very compact structure resulting in low radio-electric space occupancy, easy to reproduce and inexpensive, and being able to be used as an element of a linear or two dimensional network antenna with small spacing pitch measured in wave-length.

SUMMARY OF THE INVENTION

1. An electromagnetic wave radiator comprising:

a radiating element;

a supply device;

said supply device comprising:

a metal parallelepipedic case a dielectric plate with median longitudinal axis, positioned inside said case, being metalized on one face for forming two parallel conducting first strips, symmetrical with respect to said axis, forming a slot line;

Said radiating element comprising:

a prolongating member of said dielectric plate, said member being metalized for forming two conducting second strips, symmetrical with respect to said axis, one end of them prolongating said two first strips and the second end of them being formed for radiating energy.

The invention also relates to a use of the wave radiator, characterized by the fact that this radiator forms an elementary source of an electronic sweep antenna which, associated with a phase-shifter, forms an element called a module of a phase-shift network. The fact that the radiating element, and its supply device and the phase-shifter formed on a dielectric substrate from a slot line, are all three connected together directly presents a particularly interesting advantage for the construction of a network antenna.

BRIEF DESCRIPTION OF THE DRAWINGS

Other features and advantages of the invention will be better understood from the detailed description which follows with reference to the accompanying drawings, given solely by way of example and in which.

The elements bearing the same references in the different figures fulfill the same functions and provide similar results.

DESCRIPTION OF THE PREFERRED EMBODIMENTS

Figure 1:
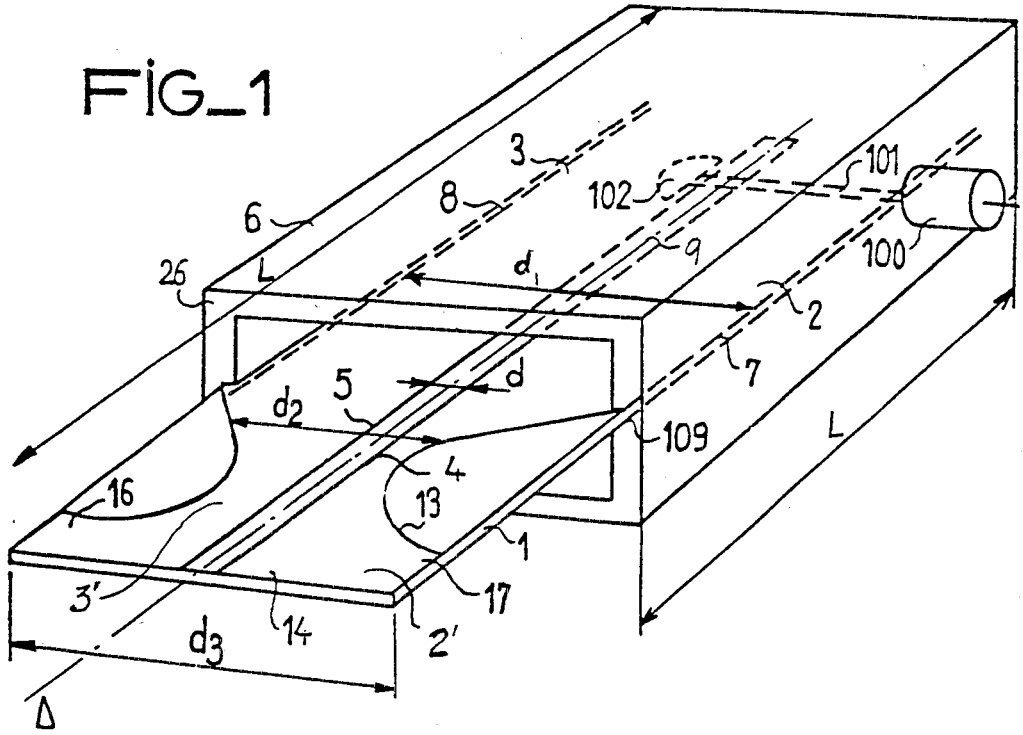
FIG. 1 is a perspective view of a wave radiator of the dipole type in accordance with the invention.

Referring to FIG. 1, a wave radiator in accordance with the invention is formed from a dielectric substrate plate 1, of length L and with median longitudinal axis Δ, on one of the faces of which are deposited two first conducting strips 2 and 3, symmetrical with respect to axis Δ. The facing edges 4 and 5 of the two strips are parallel.

The wave radiator includes a radiating element 14 (with which is associated a supply device) formed as radiating element from the dielectric plate 1.

The supply device is formed by a slot line 9 placed inside a parallelepipedic metal case 6 having the same length $L_1$ as that of the slot line. The slot line 9 is formed from two conducting strips 2 and 3 of total width $d_1$ whose facing edges 4 and 5 are separated by a constant distance d, thus defining the width of the slot line, and the other two edges 7 and 8 of which, opposite the preceding ones 4 and 5, are in electrical contact with the internal walls of the metal case 6. These two strips 2 and 3 are equivalent to two parallel metal planes.

Practically, the dielectric plate 1 may rest on two shoulders or in two grooves 109 formed on the internal walls of case 6. To provide the best possible electric contact between edges 7 and 8 of the slot line 9 and the case, they are soldered or bonded by means of a conducting adhesive to the internal walls of the case. Thus, good mechanical strength of plate 1 with respect to case 6 and good electric contact of the slot line 9 with the case are provided at one and the same time. In addition, slot line 9 is placed inside the case so as to avoid any propagation other than in the slot itself. The dielectric plate 1 supporting the slot line is placed substantially in the longitudinal median plane of case 6 so as to avoid disymmetry of the field pattern.

The case, when placed below cut-off, allows the two conducting strips 2 and 3 to be equivalent to two parallel metal planes of infinite width with respect to the slot line. The case 6 is therefore a screen and should not behave as a radiating wave-guide.

The radiating element is also formed from the dielectric plate 1. It comprises two second conducting strips 2' and 3', symmetrical with respect to axis Δ, extending respectively the first strips 2 and 3 and separated by the same distance d as these latter. These two second strips are connected to the two first strips 2 and 3 by two thinned down conducting parts forming a transition 13 between the slot line 9 and the radiating element 14, the transition being such that the width $d_2$ of the two second conducting strips 2' and 3' varies continuously.

In FIG. 1, the radiating element 14 is of the dipole type, the two conducting parts being formed in this case by two stems 16 and 17.

In the particular case of the practical embodiment shown in FIG. 1, the slot line 9 and the radiating element 14 are both photo-etched (also known as photolithography) on the dielectric plate 1 whose width in case 6 is equal to, greater than or less than its value outside the case. The slot line 9 is excited by a coaxial line 100 disposed perpendicularly to the slot and against the metal case 6. The core of this coaxial line is extended by a wire 101, also photo-etched on the dielectric plate 1 on the face opposite that of the slot line, the transition between this wire and the slot line being formed by a quarter-wave metalized matching butterfly wing 102. This latter as well as wire 101 are shown with broken lines in FIG. 1. The dielectric substrate may, for example, be ceramic or epoxy glass.

Figure 2:
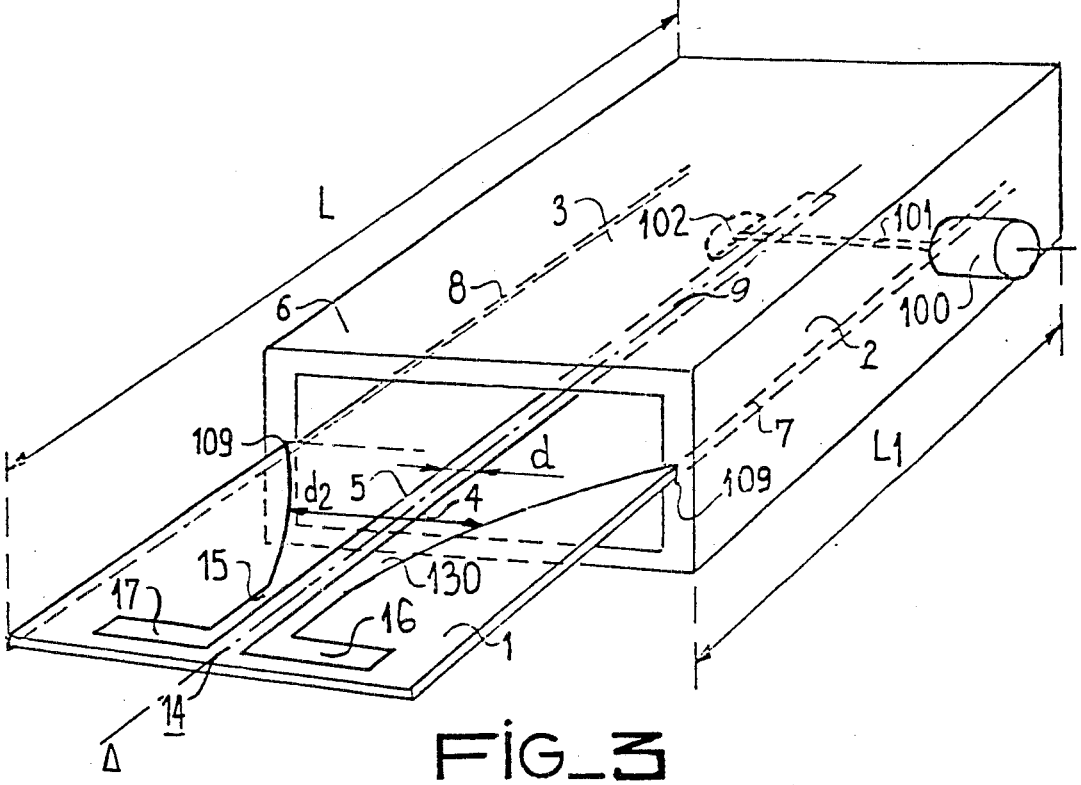

FIG. 2 is a perspective view of another embodiment of a wave radiator of the dipole type in accordance with the invention.

Beyond the slot line 9, the width $d_2$ of the conducting strips 2 and 3 decreases to form a transition 130 between the slot line 9 and a section of the twin-wire line 15 whose end, opposite the slot line 9, is connected to the stems 16 and 17 of a dipole forming the radiating element 14. Transition 130 may have a width $d_2$ which varies in a circularly curvelinear fashion, in an exponential manner, or in accordance with a curve representative of a mathematical function which may be transcendental.

As before, the slot line 9, the transition 130, the twin-wire line section 15 and the stems of dipole 14 are photoetched on the dielectric plate 1.

Figure 4:
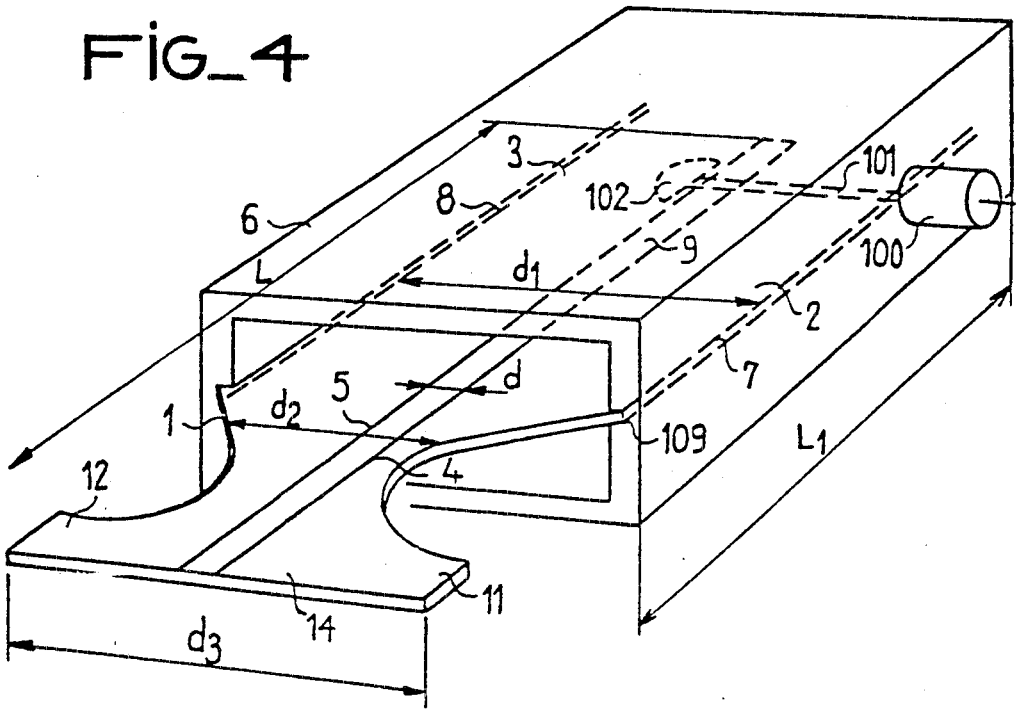
FIGS. 2 to 4 are perspective views of other embodiments of a wave radiator of the dipole type in accordance with the invention.
Figure 3:
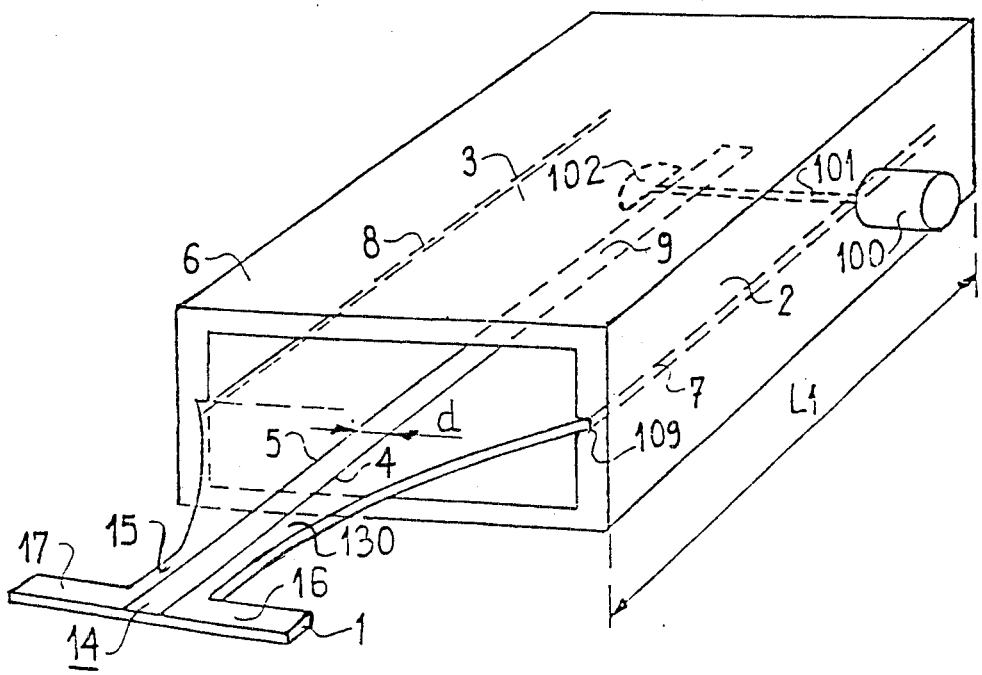

In other particular embodiments shown respectively in FIGS. 3 and 4, the dielectric plate 1 may be cut out so as to follow the width of the strips forming the transition 13 and 130 and the twin-wire line 15, but all types of cut-out shapes between these two cases are also possible. The preferred embodiment is the one shown in FIG. 4.

Figure 5:
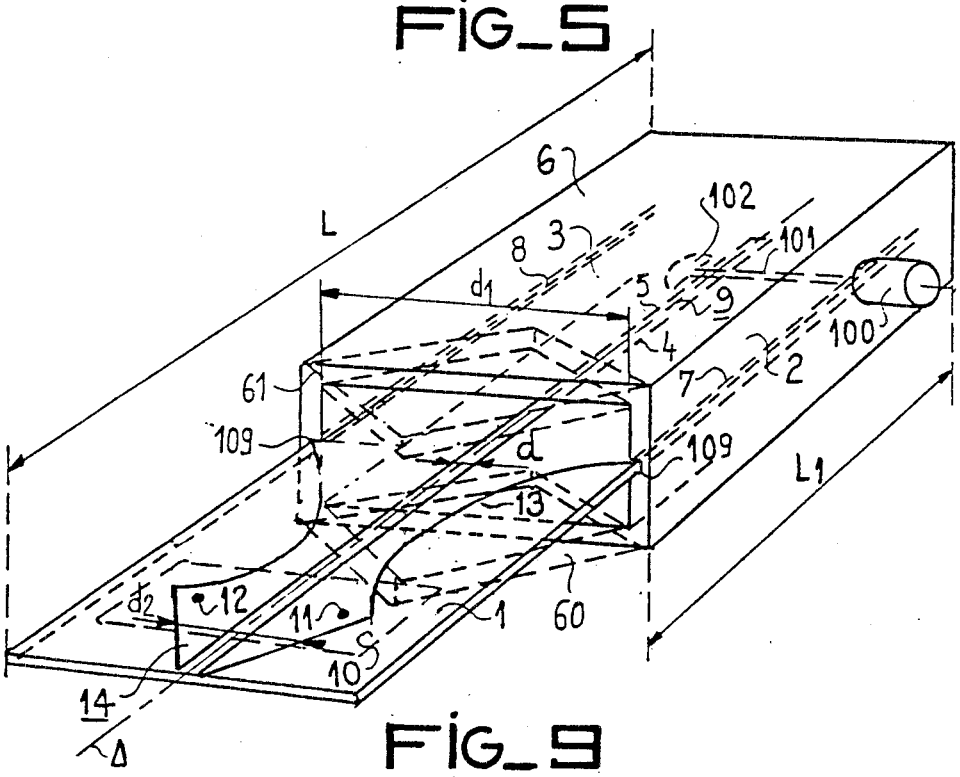
FIG. 5 is a perspective view of a wave radiator in accordance with the invention.

FIG. 5 represents a perspective view of a wave radiator in accordance with the invention, in which the radiating element 14 has a special shape. The supply device is identical to the one previously described for the other figures and the radiating element 14 is formed, on the one hand, by two parts in the shape of a triangle forming an extension of each conducting strip forming the transition 13, the triangle forms a slotted point at the end of the plate 1 and, on the other hand, by a rectangular conducting strip portion 10 perpendicular to axis Δ and placed on the face of the plate opposite that on which the two strips 2 and 3 are deposited.

Variations of this solution consist in putting the strip portion 10, placed on the opposite face of dielectric plate 1, at the potential of one of the strips 2 or 3 forming the slot line 9. This is possible by forming through-holes in the dielectric plate 1 and introducing therein a conducting wire 11 or 12 whose ends are soldered on one side to the strip portion 10 and on the other to a strip 2 or 3, or both, forming the solid line.

The position of the holes providing electric connection between the associated radiating elements, the slot line 9 and the portion of strip 10, determines the forms of the radiating pattern for the structure thus created, with respect to those given by the basic model without electric connection. For particular positions of these holes, the radiating pattern in plane E presents a hollow in the axis. It is then of the difference type. This model with a small bandwidth for correct operation may nevertheless correspond to particular applications for which this type of pattern is desired.

Good matching may also be obtained between the radiating element and the slot line as well as a large operating bandwidth by varying the shape of the opening of the guide as shown in FIG. 1, with broken lines as shown in FIG. 5. For example, the opening of the case, rectangular in cross-section, presents on the two large parallel faces 60 and 61 of the case two V shaped projection extending in the direction of axis Δ and symmetrical with respect to this axis.

The opening of the case may also comprise in opposed relation two V shaped indentations directed inwardly of the case.

Figure 6:
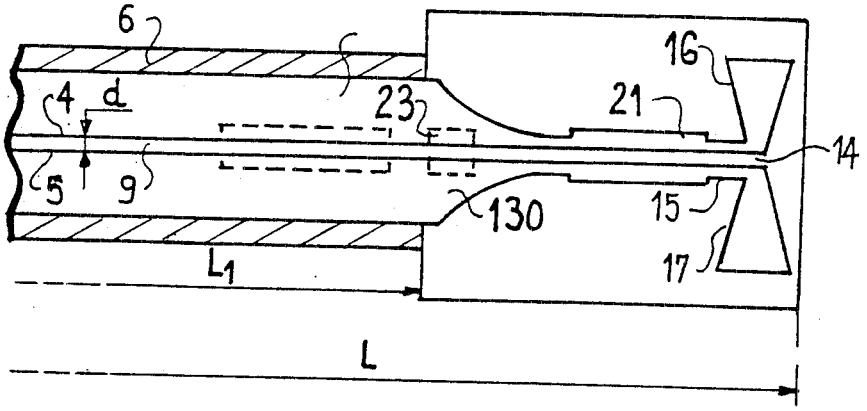
Figure 7:
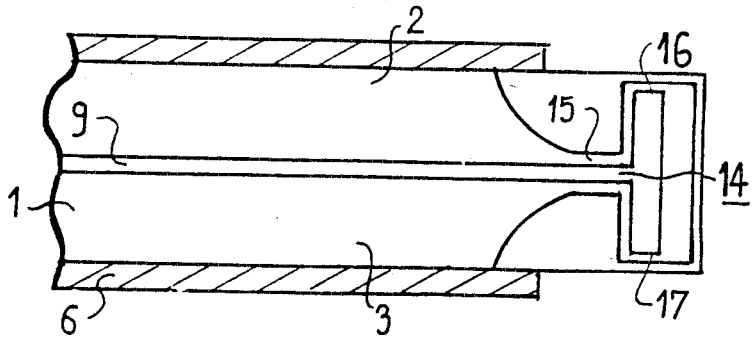

In the case where the element is of the dipole type, the radiating dipole may be a whole wave or half-wave dipole, its stems 16 and 17 being formed by rectangular or flared tongues, called butterfly wings, like those in FIG. 6 for example. When it is desired to increase the characteristic impedance of the source, a so-called turned-in dipole may be used such as the one shown in FIG. 7.

Matching of the radiating dipole, whatever its type, is provided by the dimensions of the transition between the slot supply line and the twin-wire line extending to the stems of the dipole.

FIG. 6 is a longitudinal section of a radiating source in accordance with the invention, on which is shown the impedance transformer 21 of a length equal to a quarter wave at the central frequency of the operating band of the source. This transformer may be formed either at the level of the twin-wire line 15 or at the level of the slot line 9, as is shown, with a broken line in the figure. To further improve this matching, it is possible to associate with this preceding transformer punctual capacities, in the form for example of metalized surfaces 23 deposited on the face of the dielectric plate opposite the slot line, and shown with broken lines in FIG. 6.

Figure 9:
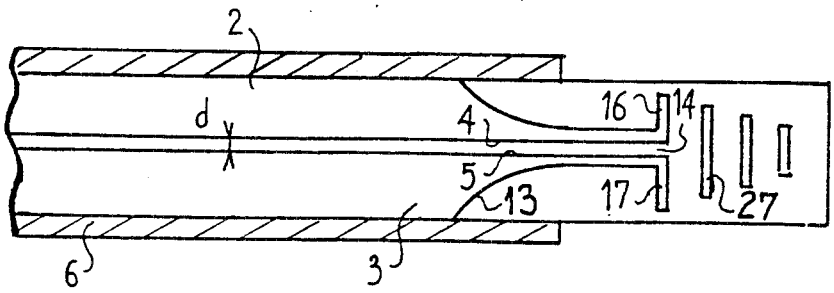
FIGS. 6 to 9 are longitudinal sections of different embodiments of a wave radiator according to the invention.
Figure 8:
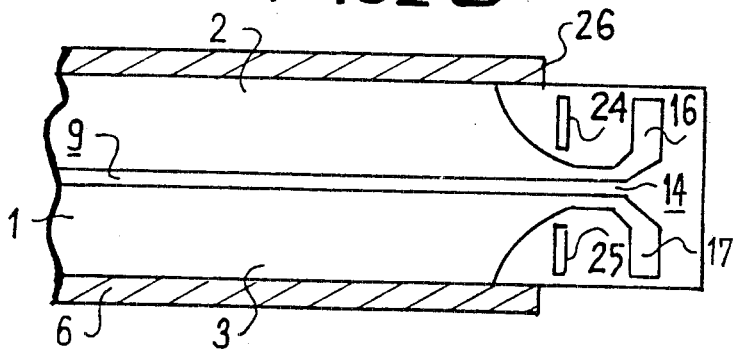

Modifications of the radiating pattern of the source in the invention may be obtained by association of a reflector placed at a distance equal to a quarter of the operating wave-length, formed for example, as shown in FIG. 8, by two metal strips 24 and 25 photo-etched on the dielectric plate 1 in the plane of the opening of case 6 or else by the edges 26 of case 6 according to its opening cross section. Directivity may be improved by the presence of directors placed in front of the dipole. In the case of FIG. 9, three directors 27 or photo-etched metal strips, are placed parallel to dipole 14 and are of decreasing size in the direction of the emitted radiation. The electromagnetic characteristics of the slot line of the supply device of the invention are defined by the width d of the slot, the thickness and the value of the dielectric constant of the plate 1 supporting it, as well as the mechanical dimensions of the metal case in which it is placed.

Figure 10:
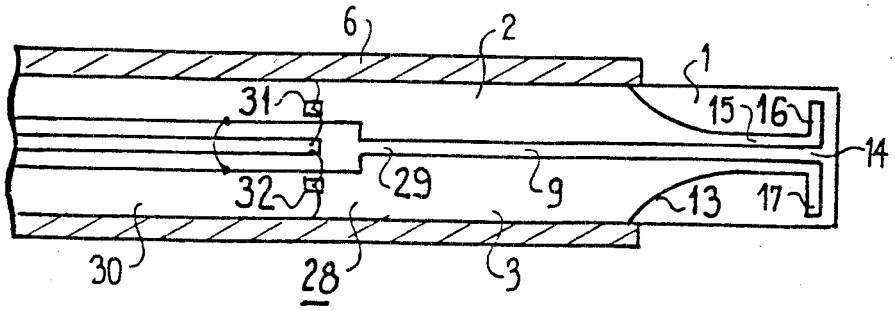
FIG. 10 is a longitudinal section of a wave radiator according to the invention associated with a phase-shifter.
Figure 11:
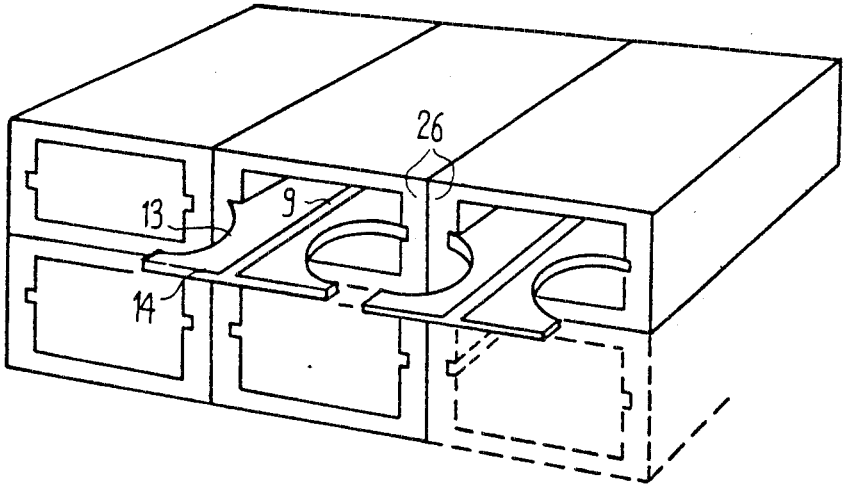
FIG. 11 is a perspective view of a portion of a network antenna fraction constructed in accordance with the invention.

As was said at the beginning of this description, a very important advantage of such a wave radiator is the possibility of forming a module by placing, upstream of the supply device, a phase-shifter 28 as shown in FIG. 10. This phase-shifter 28 comprises a slot line 29 coupled to a coplanar line 30 having the same axis of propagation and a device with two diodes 31 and 32 situated in the coupling zone of these two transmission lines, as has been described in French Pat. No. 2 379 196 filed in the name of the applicant. Case 6 protects radio-electrically the diodes of the phase-shifter. It can be seen that such a module presents reduced dimensions and avoids insertion losses. As has been said from the advantage point of view, when such a source is used as an element for a network antenna, such as shown in FIG. 11, all the metal edges 26 of the cases 6 placed side by side, form a very large reflecting surface becoming a plane in which are to be found solely the openings of the cases through which pass the radiating dipoles. The reflector thus formed is at a distance of a quarter wavelength from the stems of the dipole. It can be seen that a case in which is placed each slot line of the wave radiator of the invention allows several radiators to be stacked together.

In the source described here, the height of the case is such that it defines a filter for the below cut-off frequencies in horizontal polarization.

Figure 12:
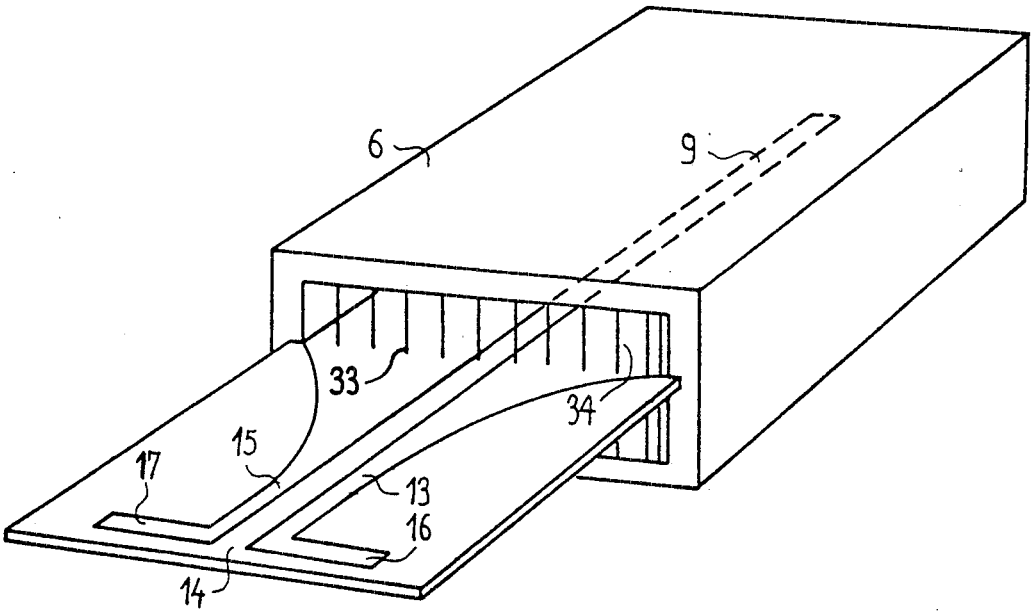
FIG. 12 is a perspective view of a wave radiator in accordance with the invention, showing matching wires.

On the other hand, for a vertically polarized wave, the width of the case is such that the cut-off frequency is placed much lower, the positioning of a network of metal wires parallel to the crossed polarization filter offsets this defect see FIG. 12.

FIG. 12 shows a radiating source whose supply device comprises, at the level of opening 34 of the case, a network of parallel conducting wires 33, whose direction is orthogonal to that of the electric field E radiated by the slot line 9. When this source is used as an element of a network antenna, for example, operating both for transmission and reception, with such a network any wave is reflected whose polarization direction is perpendicular to that radiated by the source. Thus, an electromagnetic wave radiator has been described which is fed by a slot line deposited on a dielectric substrate plate whose principal advantage is, besides the low radioelectric space occupancy when a dielectric substrate is used having a high dielectric constant, a very large bandwidth of the order of 20%. Consequently, network antennae may be constructed with small spacing pitch measured in wave length.

Figure 13:
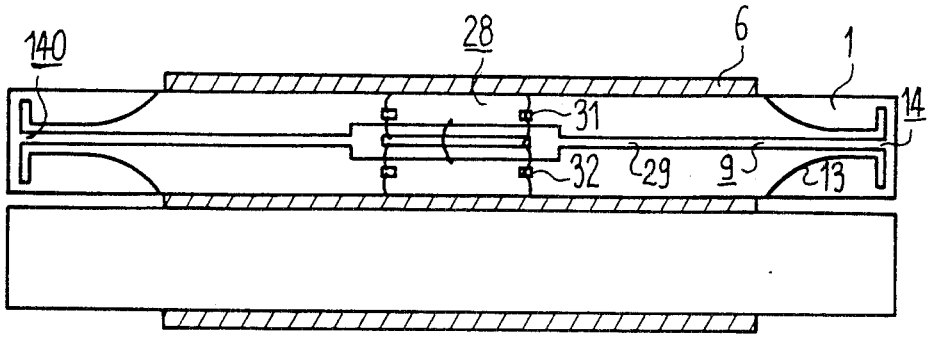
FIG. 13 is a longitudinal section of a lens portion formed from the invention.

FIG. 13 shows a longitudinal section of a lens portion able to be illuminated on one side by a source. This lens is formed by a stack of modules each formed by two wave radiators in accordance with the invention placed symmetrically with respect to a diode phase-shifter 28. The source illuminates the elements 140, for example, which thus receive energy. Then, by means of the phase-shifters 28, the different signals are phase-shifted before being radiated by elements 14. This embodiment, formed from a slot line 9 formed on the same dielectric plate 1 and placed in the same case 6, simplifies the problems of impedance matching.

What is claimed is:

1. An electromagnetic wave radiator comprising:

a metal parallelepipedic case having an opening;

a dielectrical plate with a median longitudinal axis, said plate being metalized on one face thereof and positioned inside said case; and a slot line formed by two parallel conducting first strips formed on said dielectric plate and in electrical contact with said case and symmetrical with respect to said axis, said case being dimensioned below cut-off with respect to said slot line to serve as a nonradiating waveguide shield; and a radiating element including:

a prolongating member extending said dielectric plate through said opening, said member being metalized on one face thereof; and two conducting second strips, symmetrical with respect to said axis and formed on said one face of said member, one end of said second strips prolongating said two first strips and a second end of said strips formed for radiating energy.

2. A radiator as claimed in claim 1, wherein said two parallel conducting first strips have facing edges which are symmetrical with respect to said axis and are separated by a constant distance d and outer edges which are connected electrically to internal walls of said case, the length of said slot being equal to the length $L_1$ of the case.

3. A radiator as claimed in claim 2, wherein said case has two internal walls in which two grooves are formed for supporting said dielectric plate.

4. A radiator as claimed in claim 2, wherein said two second strips are separated by the said distance d.

5. A radiator as claimed in claim 4, wherein said two second strips are connected to said two first strips by two thinned down conducting parts forming a transition between said slot line and said radiating element.

6. A radiator as claimed in claim 5, wherein said transition has a width $d_2$ which varies continuously.

7. A radiator as claimed in claim 6, where said width d2 varies in a circular curvelinear manner.

8. A radiator as claimed in claim 6, wherein said radiating element is of the dipole type.

9. A radiator as claimed in claim 8, wherein said dipole has stems which are connected to one end of said transition, opposite said slot line, by a twin-wire line section.

10. A radiator as claimed in claim 9, further including an impedance transformer having a length equal to a quarter of a wavelength at a central frequency of the operation band, connected to one of (a) said slot line, and (b) said twin-wire line.

11. A radiator as claimed in claim 9, further including director strips placed perpendicular to said slot line and downstream from said stems with respect to the direction of the emitted radiation.

12. A radiator as claimed in claim 9, wherein said prolongating member is cut out so as to follow said varying width $d_2$, said twin-wire line and said radiating element.

13. A radiator as claimed in claim 5, wherein said second end of said second strips is formed in the shape of a triangle, said triangle forming a slotted point at said second end, and further including a rectangular conducting strip portion placed perpendicular to said axis and on a second face of said plate.

14. A radiator as claimed in claim 13, further including at least one conducting wire having a first and a second end, said first wire end being placed in electric contact with said rectangular conducting strip portion by a through hole passing through said prolongating member, said second wire end being in electric contact with one of said second conducting strips so as to put said rectangular conducting strip portion and said second conducting strips at the same electric potential.

15. A radiator as claimed in claim 13, wherein said case has two large faces parallel to said dielectric plate, in each of said large faces is formed a V shaped projection extending in a direction of said axis and symmetrical with respect to said axis.

16. A radiator as claimed in claim 13, wherein said case has two large faces parallel to said dielectric plate, in each of said large faces is formed a V shaped indentation extending in a directin parallel to said axis and symmetrical with respect to said axis.

17. A radiator as claimed in claim 1 wherein said conducting strips are deposited by a photolithography process on said dielectric plate.

18. A radiator as claimed in claim 1, further including two metal reflecting strips deposited on said one face of said dielectric plate, in the plane of said opening of said case.

19. A radiator as claimed in claim 1, wherein said opening of said case includes a network of parallel conducting wires whose direction is perpendicular to an electric field E radiated by said slot line.

20. A lens device for receiving electromagnetic signals, phase shifting said signals, and radiating said phase shifted signals, comprising two radiators according to claim 1 placed coaxially with their respective radiating elements pointed in opposite directions and connected together by a diode phase shifter which includes an output slot line which is colinear with and connected to the slot line of each of said two radiators.

21. A radiator according to claim 1 further including a diode phase shifter comprising:

a phase shifter slot line extending from said slot line in a direction opposite said prolongating member;

two colinear slot lines extending from said phase shifter slot line and separated by a zone;

a first diode coupled between said zone and one wall of said case, and located in a coupling zone of said phase shifter and colinear slot lines; and a second diode coupled between said zone and a wall of said case opposite said one wall, and located in said coupling zone.

22. A radiator as claimed in claim 5, wherein said dipole has stems which are connected to one end of said transition, opposite said slot line, by a twin-wire line section.

23. A radiator as claimed in claim 6, wherein said width $d_2$ varies in an exponential manner.

24. A radiator as claimed in claim 6, wherein said width $d_2$ varies in accordance with a curve representing a transcendental mathematical function.

* * * * *